US009067232B2

(12) United States Patent
Gaardsoe et al.

(10) Patent No.: US 9,067,232 B2
(45) Date of Patent: Jun. 30, 2015

(54) APPARATUS FOR THE SPREADING OF ADHESIVE MATERIAL

(75) Inventors: Nicolai Gaardsoe, Haslev (DK); Peter Tretow-Loof, Kgs. Lyngby (DK)

(73) Assignee: Udviklingsselskabet AF 2002 APS, Haslev (DK)

( * ) Notice: Subject to any disclaimer, the term of this patent is extended or adjusted under 35 U.S.C. 154(b) by 383 days.

(21) Appl. No.: 13/807,985

(22) PCT Filed: Jul. 4, 2011

(86) PCT No.: PCT/IB2011/052943

§ 371 (c)(1),
(2), (4) Date: Jan. 2, 2013

(87) PCT Pub. No.: WO2012/011004

PCT Pub. Date: Jan. 26, 2012

(65) Prior Publication Data

US 2013/0101339 A1 Apr. 25, 2013

Related U.S. Application Data

(60) Provisional application No. 61/361,022, filed on Jul. 2, 2010.

(51) Int. Cl.

| | |
|---|---|
| ***E04F 21/02*** | (2006.01) |
| ***B05C 17/00*** | (2006.01) |
| ***A47G 27/04*** | (2006.01) |
| ***B65D 75/58*** | (2006.01) |
| ***E04F 21/20*** | (2006.01) |

(52) U.S. Cl.
CPC ..... *B05C 17/00* (2013.01); *E04F 21/023* (2013.01); *A47G 27/0487* (2013.01); *B65D 75/5877* (2013.01); *E04F 21/20* (2013.01)

(58) Field of Classification Search
CPC ..... E04F 21/023
USPC ..... 401/48, 261, 263, 266
See application file for complete search history.

(56) References Cited

FOREIGN PATENT DOCUMENTS

| | | |
|---|---|---|
| DE | 2709771 | 9/1978 |
| GB | 2218724 | 11/1989 |
| WO | WO2007/149231 | 12/2007 |
| WO | WO2010/041083 | 4/2010 |

OTHER PUBLICATIONS

International Search Report on related PCT application (PCT/IB2011/052943) from International Searching Authority (EPO) dated Nov. 11, 2011.

International Preliminary Report on Patentability on related PCT application (PCT/IB2011/052943) from International Searching Authority (EPO) dated Jul. 11, 2012.

*Primary Examiner* — David Walczak
*Assistant Examiner* — Joshua Wiljanen
(74) *Attorney, Agent, or Firm* — Klein, O'Neil & Singh, LLP

(57) ABSTRACT

The present invention relates to an apparatus for the application of adhesive materials, e.g. flooring or tile adhesive or similar for the laying of flooring or roofing surfaces, where the apparatus is comprised of a frame for the securing of a trowel blade (25) in its correct position with regard to the subfloor over which it is being moved, and where the apparatus furthermore comprises at least one receptacle chamber (8) for a container (1) containing adhesive material, wherein a first wall portion (10) of said receptacle is provided with a first through opening (10!) or channel through the wall portion of such a shape that it mates with a corresponding outlet member (4) provided on said container (1) for adhesive material, whereby, when the container (1) is placed in the receptacle chamber (8), adhesive material can flow from the container (1) through said first wall portion (10) and into an exhaust chamber (9) of the apparatus, from which exhaust chamber (9) the adhesive material during use of the apparatus is spread over said subfloor, upon which adhesive is to be applied. The invention furthermore relates to a container that is provided with such outlet means that it can only be used together with the apparatus, if characteristics relating to dimensions, shape and orientation of the outlet member of the container correspond to similar parameters of the apparatus By these means it is prevented that unauthorized containers are used together with the apparatus

10 Claims, 23 Drawing Sheets

SECTION A-A

APPARATUS FOR THE SPREADING OF ADHESIVE MATERIAL

CROSS-REFERENCE TO RELATED APPLICATION

This application is a national phase filing, under 35 U.S.C. §371(c), of International Application No. PCT/IB2011/052943, filed Jul. 4, 2011. the disclosure of which is incorporated herein by reference in its entirety.

FEDERALLY SPONSORED RESEARCH OR DEVELOPMENT

Not Applicable

TECHNICAL FIELD

The present invention relates generally to the spreading of adhesive materials, and more specifically to an apparatus and a corresponding method for spreading a layer of adhesive over a surface, such as a floor as well as to a container specifically designed for application in the apparatus according to the invention.

BACKGROUND ART

Numerous types of flooring are laid upon underlying sub floors or concrete slabs and fixed by using adhesive materials. The adhesive must be spread evenly over the underlying surface prior to the placement of the covering material. For example parket floors, wooden floors, laminated boards, tiles, carpets or roll out flooring materials are all applied over an adhesive. It should be noted, however that the present invention is not limited to flooring but can for instance be utilised in the laying of roofing materials as well.

Typically, the adhesives are spread by a hand trowel such as the one described in EP 1,018,585A1, where the persons spreading the adhesive would carry out the work on their knees. This result in the work being physically difficult and relatively slow, especially where large areas like industrial complexes, sports arenas, office areas etc. are concerned.

Attempts have been made in the past to improve on this known technique but with limited success. The improvements have typically involved the trowel being able to be used whilst the person is in an upright position. Examples of these can be seen in U.S. Pat. Nos. 4,982,470, 3,803,662 and 3,611,470, where the tool can either be dragged or drawn to spread the adhesive layer.

As mentioned above, these adhesive spreaders have various limitations and are not as effective as they might be. It has been noted that there is still a need to be able to reliably spread an even layer of adhesive material using non-complex machinery, which can be easily cleaned after use. Machinery known in the field uses compressors and external electrical sources to apply the adhesive and power the machinery. This has the disadvantage of lacking versatility, due to the size and weight of the machinery, and furthermore because large compressors are needed to be set up before the spreader can function and many building sites where the spreader may be used cannot be relied upon the have electrical sources.

It would be desirable to provide a spreader which could lay a membrane or layer of adhesive material of a predetermined thickness with good accuracy and which is easy to use from a standing position. It would also be desirable if the spreader had some capability to reliably and evenly distribute the adhesive material ahead of the oncoming spatula blade. A further desirable attribute would be the ability to remove excess adhesive material when required. To accomplish these and other pertinent effects with a tool which is easy to maintain and clean and which requires no external input other than the driving force given by the person operating it would also be most desirable.

From the applicant's prior international application WO 02/100555 is known an apparatus for laying beds of an adhesive on a surface such as a floor.

From WO 2010/041083 is known another apparatus for laying of beads of adhesive on a surface to be covered. Said apparatus comprising a wheeled chassis supporting a reservoir of adhesive, an adhesive dispensing head having a plurality of outlet nozzles for adhesive supplied thereto via a pipe connecting the reservoir to the dispensing head. The apparatus is furthermore power driven for driving the apparatus at a constant speed.

From DE 27 09 771 is known yet another wheeled apparatus for laying of beads of adhesive on a surface. The disclosed apparatus comprises a container for a bag filled with adhesive. During use the adhesive is pressed through an opening in the bag and spread in a layer on the floor.

SUMMARY OF THE INVENTION

The above and further objects and advantages are attained with an apparatus, a container for adhesive material and a method of spreading such material according to the independent claims. Various embodiments of the invention are defined in the dependent claims and/or in the following description.

According to a first aspect, the present invention relates to an apparatus for the application of adhesive materials, e.g. flooring or tile adhesive or similar for the laying of flooring or roofing surfaces, where the apparatus is comprised of a frame for the securing of a trowel blade in its correct position with regard to the subfloor over which it is being moved, and where the apparatus furthermore comprises at least one receptacle for a container containing adhesive material, wherein a wall portion of said receptacle is provided with an opening or channel through the wall portion of such a shape that it mates with a corresponding outlet member provided on said container for adhesive material, whereby, when the container is placed in the receptacle, a fluid communication path is established from the container through said wall portion and into an exhaust chamber in the apparatus, from which exhaust chamber the adhesive material during use of the apparatus is spread over said subfloor, upon which adhesive is to be applied.

Some of the embodiments of the apparatus according to the invention described in the detailed description of the invention and actually shown in some of the figures comprise two receptacle chambers for containing a container of adhesive material. It is understood that also only a single such receptacle chamber could be used in the apparatus of the invention all well as more than two chambers, all according to specific preferences and/or needs. An embodiment containing only one receptacle chamber is also shown and described in the detailed description of the invention.

According to a second aspect, the present invention relates to a container for adhesive material provided with an outlet member adapted for use in the above mentioned apparatus.

According to a third aspect, the present invention relates to a method for applying adhesive material on a surface, wherein the method comprises the following steps:

(a) providing an apparatus for application of adhesive material on a surface, where the apparatus comprises a frame for the securing of a trowel blade in its correct position with regard to a subfloor over which it is being moved, at least one receptacle for accommodating a container containing the adhesive material and an exhaust chamber from which the adhesive material is applied on the surface, and wherein a wall separates said receptacle from said exhaust chamber, wherein the wall is provided with a through opening or channel of a given cross sectional shape;

(b) providing a flexible container or bag provided with an outlet member of a cross sectional shape corresponding to the cross sectional shape of said opening or channel;

(c) placement of said container or bag in said receptacle such that said outlet member provides fluid communication through said opening or channel, whereby adhesive material in said container or bag can be brought to flow from the container or bag to said exhaust chamber and from this chamber via the trowel blade to the underlying surface.

According to a specific embodiment of the apparatus according to the invention, a dual-chamber structure is applied as an interface structure between the receptacle chamber in which the container of adhesive material is provided and the exhaust chamber of the apparatus. Thus, an extra chamber is provided between said wall portion of the receptacle chamber and the exhaust chamber, such that when the outlet member of the container does not extend entirely from the receptacle chamber to the exhaust chamber, but rather terminates in the intermediate extra chamber, adhesive material is not properly conveyed from the container to the exhaust chamber.

According to a specific, preferred embodiment of the invention said interface structure separating the receptacle chamber from the exhaust chamber comprises two juxtaposed walls, each provided with through openings formed for passage of the outlet member of the container. According to a preferred embodiment the through opening in one wall of the interface structure is displaced relative to the corresponding through opening in the second wall of the interface structure, whereby only an outlet member in the container that is inclined relative to the surface of the container on which it is provided can pass both through openings and hence from the receptacle chamber through the interface structure and to the exhaust chamber of the apparatus. It should be noted that the interface structure could also comprise more than the two walls described above without departing from the scope of the present invention. Furthermore, an alternative to the two (or more) walls interface structure a single thick wall could be used, through which thick wall a channel is formed to accommodate the inclined outlet member of the container.

BRIEF DESCRIPTION OF THE DRAWINGS

The present invention will be better understood with reference to the following detailed description of embodiments of the invention in conjunction with the figures, where.

DETAILED DESCRIPTION OF THE INVENTION

In the following a number of non-limiting embodiments of the invention will be described, but it is understood that the invention may be implemented in other manners than those shown and described without thereby departing from the scope of the invention as defined by the claims.

Figure 1:
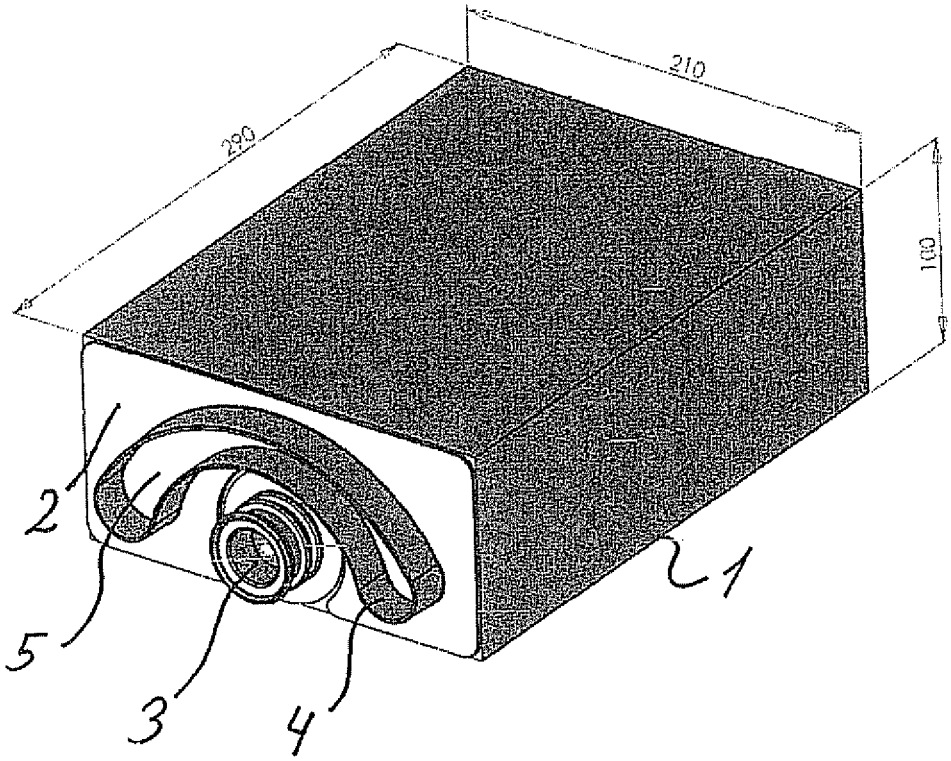
FIG. 1 shows a box-shaped flexible bag 1 for an adhesive material. On one end face of the bag is welded or glued a plastic end plate or gable 2 that is provided with an inlet 3 for providing the bag 1 with the adhesive material and an outlet 4 through which the adhesive material in the bag 1 can leave the bag and enter the exhaust chamber of the apparatus. The outlet 4 has a given predetermined shape that corresponds to a wall portion at the interface between the receptacle chamber of the apparatus, in which the bag under operation of the apparatus is placed and the exhaust chamber of the apparatus from which the adhesive is spread over the underlying surface.

With reference to FIG. 1 there is shown a box-shaped flexible bag 1 according to an embodiment of the invention for an adhesive material. On one end face of the bag 1 there is attached, for instance welded or glued, a plastic end plate or gable 2 that is provided with an inlet 3 for providing the bag 1 with the adhesive material and an outlet 4 through which the adhesive material in the bag 1 can leave the bag and enter an exhaust chamber of the apparatus according to the invention, as will be described in detail below. The outlet 4 has a given predetermined shape that corresponds to an aperture in a wall portion at the interface between the receptacle chamber of the apparatus, in which the bag under operation of the apparatus is placed and the exhaust chamber of the apparatus from which the adhesive is spread over the underlying surface. In this manner it is ascertained that the apparatus can only receive and utilise a bag that is specifically designed for this particular apparatus.

In FIG. 1 there are shown an example of typical dimensions of a container for use in an apparatus of the invention comprising two receptacle chambers. It is however understood that dimensions giver in this figure as elsewhere in the present specification are only to be regarded as non-limiting examples, and that for a one receptacle chamber apparatus the dimensions of the container will normally be larger.

Figure 16:
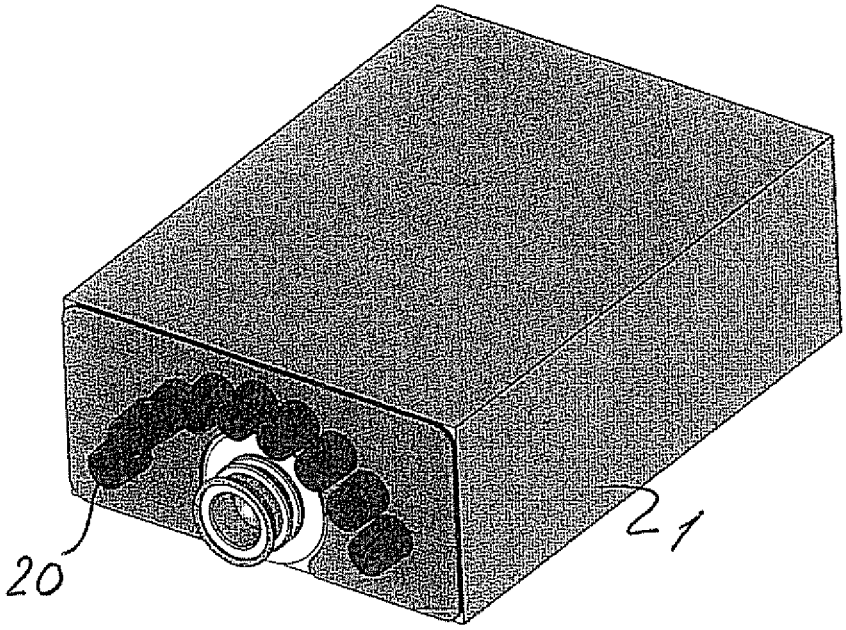
FIG. 16 shows an alternative design 20 of an outlet member of the bag 1.
Figure 17:
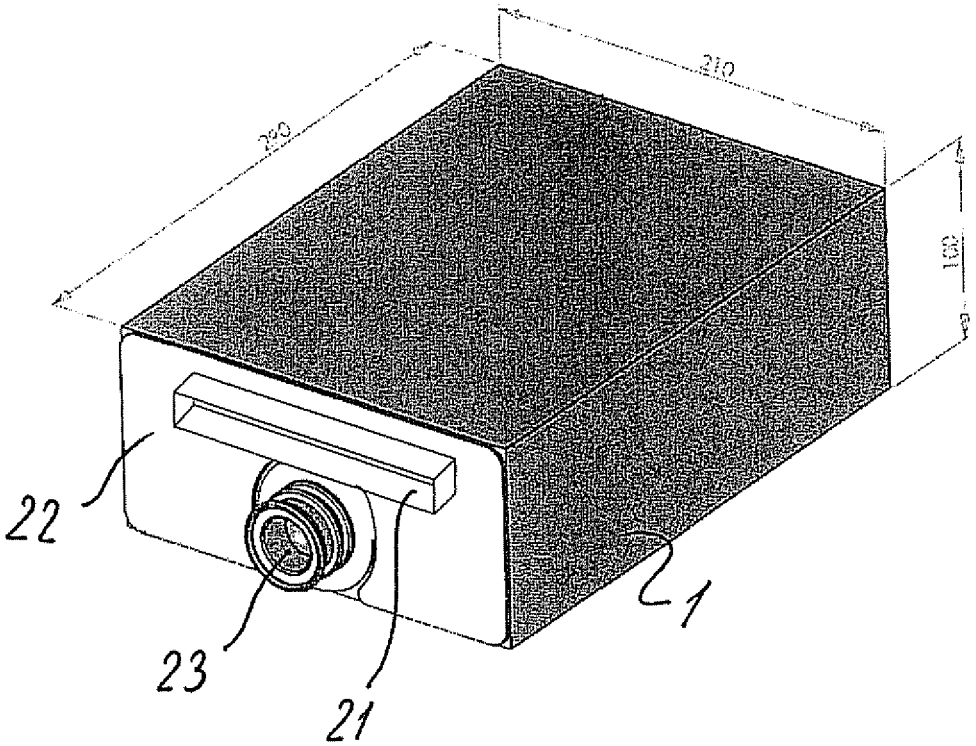
FIG. 17 shows another alternative design 21 of an outlet member of the bag 1 and an end plate or gable 22 glued to the corresponding end face of the bag and an inlet member 23 welded on the bag 1.

It is possible within the scope of the present invention to design bags of various shapes and provided with outlet portions of many different cross sectional shapes. Examples of alternative bags are shown in FIGS. 16 and 17. The bag 1 shown in FIG. 1 could also be provided with more than one, for instance two, curved outlet portions 4 of suitable dimensions, for instance placed adjacent each other in the end plate 2 of the bag.

In FIG. 1 the outlet 4 is shown extending substantially perpendicularly from the surface of the end plate 2, but according to a preferred embodiment that will be described further below the outlet 4 can extend inclined relative to the plane of the end plate 2, i.e. form an angle different from 90 degrees relative to this plane. This type of outlet 4 will require a specific design of an interface portion 27 (see FIG. 6) as will be explained below.

In the following a detailed description of an embodiment of an apparatus according to the invention for the application of adhesive materials will be described.

Figure 2:
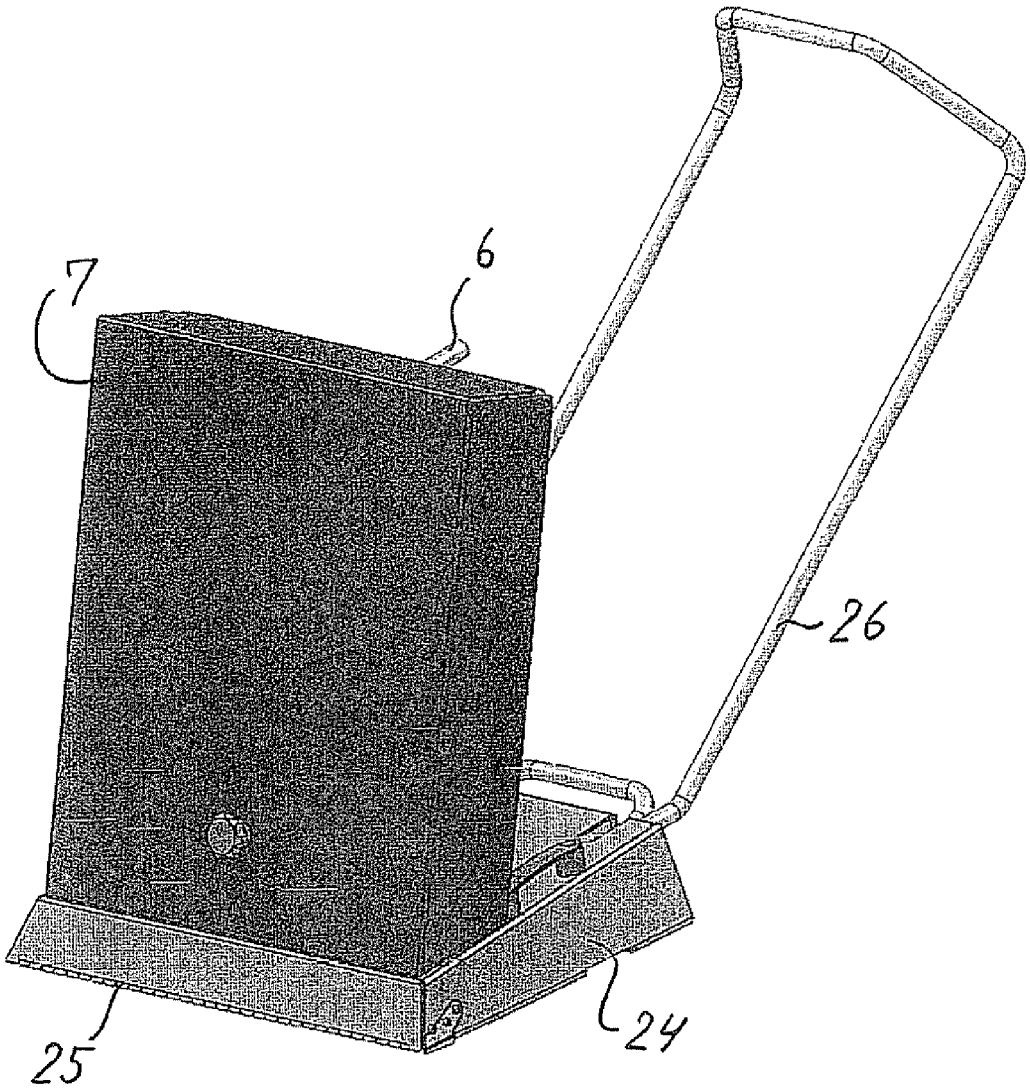
FIG. 2 shows an embodiment of the apparatus according to the invention.

With reference to FIG. 2 there is shown an embodiment of the apparatus according to the invention. The apparatus comprises basically a cover part 7 that can accommodate one or more bags containing adhesive material and a base part 24 supporting a trowel blade 25 in its correct position with regard to the subfloor over which it is being moved. The apparatus is provided with a suitable handle 26. The cover part 7 can be opened for insertion of containers in the apparatus.

Figure 3:
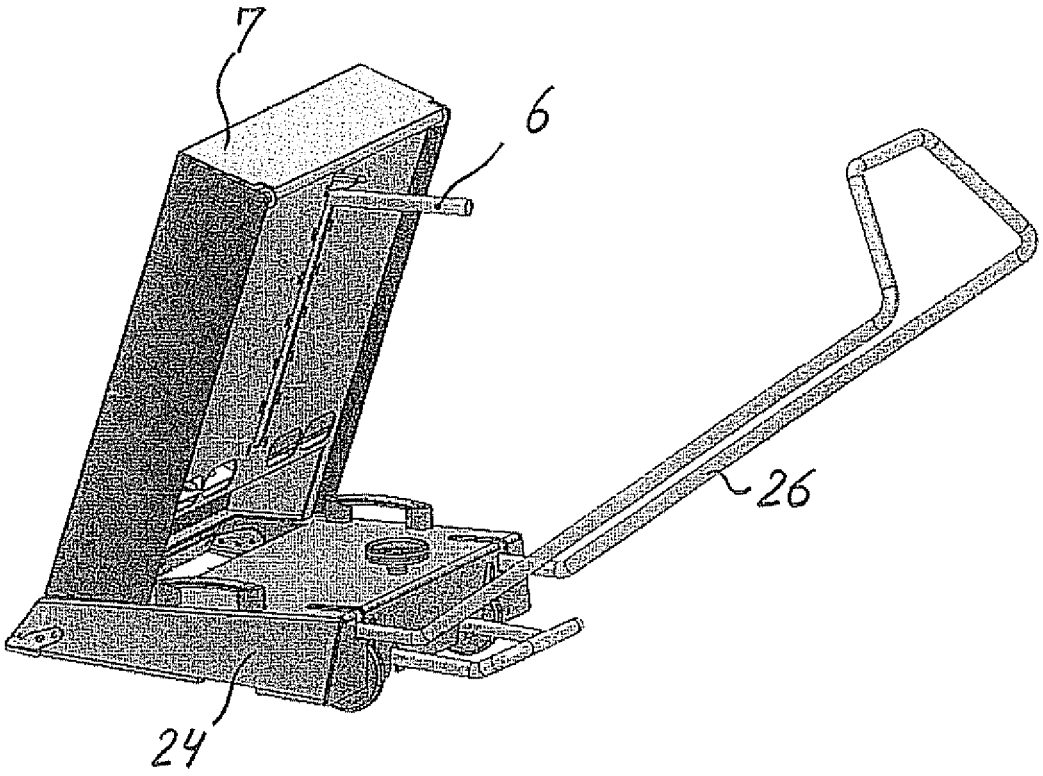
FIG. 3 shows the apparatus comprising a pump system for urging the adhesive material from the one or more bags in the apparatus to the exhaust chamber or chambers.

With reference to FIG. 3 there is shown the apparatus according to this embodiment of the invention comprising a pump system provided with a user operable handle 6 for urging the adhesive material from the one or more bags in the apparatus to exhaust chamber or chambers contained in the apparatus.

Figure 4:
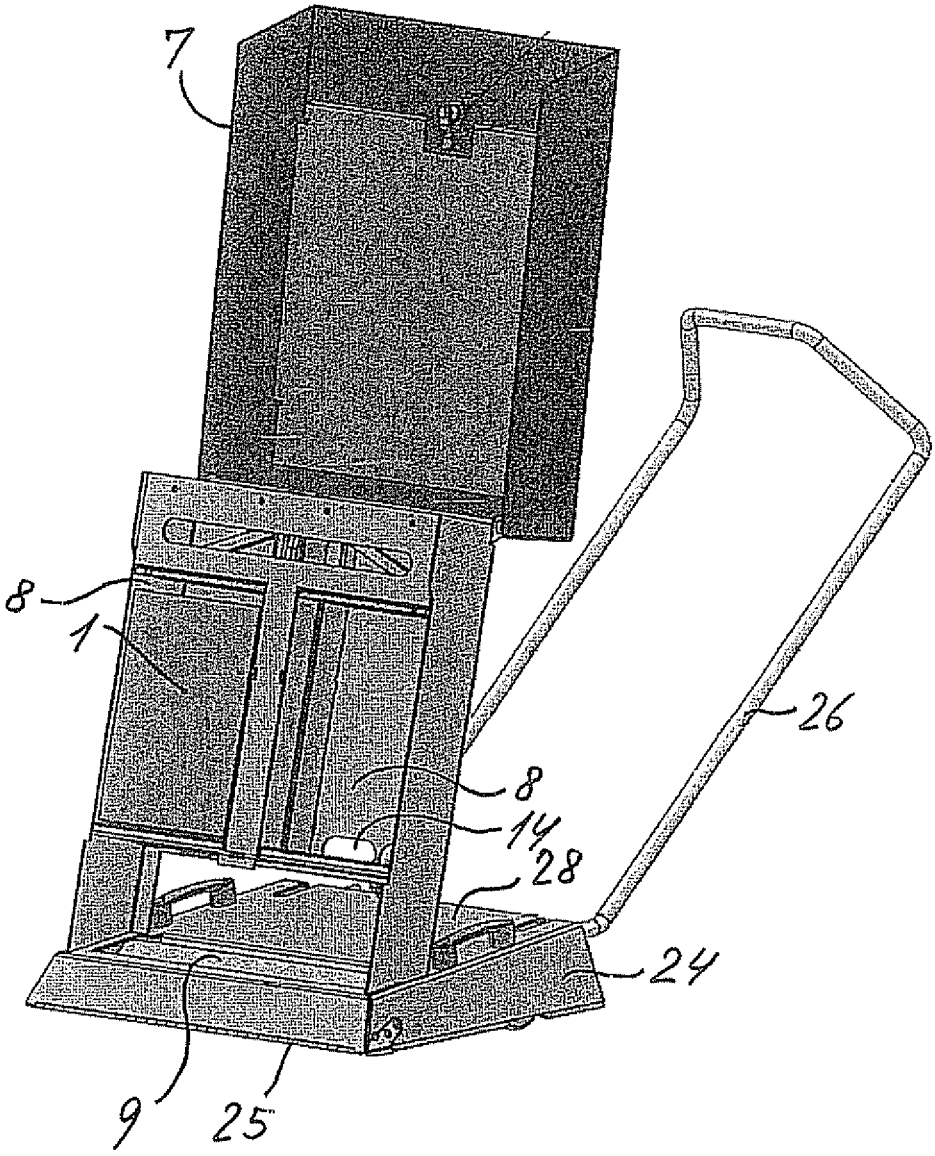
FIG. 4 shows some of the inner structure of the apparatus with the cover 7 opened. This embodiment of the apparatus comprises two receptacle chambers 8, one of these being provided with a bag 1 of adhesive material. The bags are kept in place when the cover 7 is closed.

With reference to FIG. 4 there is shown some of the inner structure of this embodiment of the apparatus with the cover 7 opened. This embodiment of the apparatus comprises two receptacle chambers 8, one of these in the shown case being provided with a bag 1 of adhesive material. The bags are kept in place when the cover 7 is closed over the opening of the respective receptacle chambers after insertion of one or two bags. FIG. 4 also shown an exhaust chamber 9 provided under the receptacle chambers 8, down into which exhaust chamber 9 adhesive is urged from the containers 1 upon operation of the pump handle 6. The figure further shows the trowel blade 25, a side face 24 of the apparatus and a rear part 28 of the apparatus. Through openings 14 are provided between the receptacle chambers 8 and the rear portion of the apparatus for a purpose that will be described below.

Figure 5:
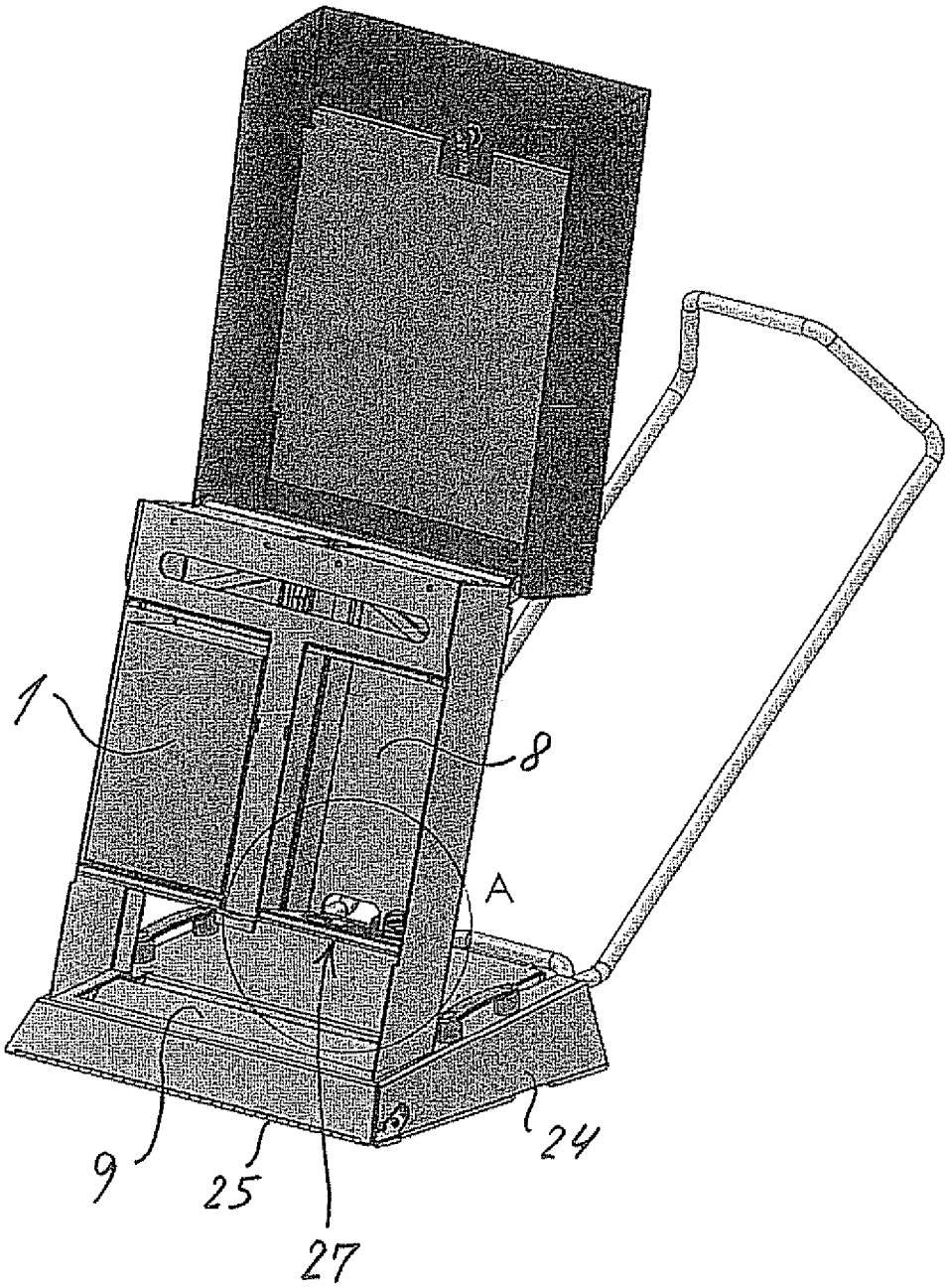
FIG. 5 shows the position of the interface between the receptacle chamber 8 and the exhaust chamber 9.

With reference to FIG. 5 there is shown the position of an interface structure 27 separating the receptacle chambers 8 from the exhaust chamber 9 that is provided in the base part 24 of the apparatus. Different implementations of this interface structure 27 will be shown and described in the following.

Figure 6:
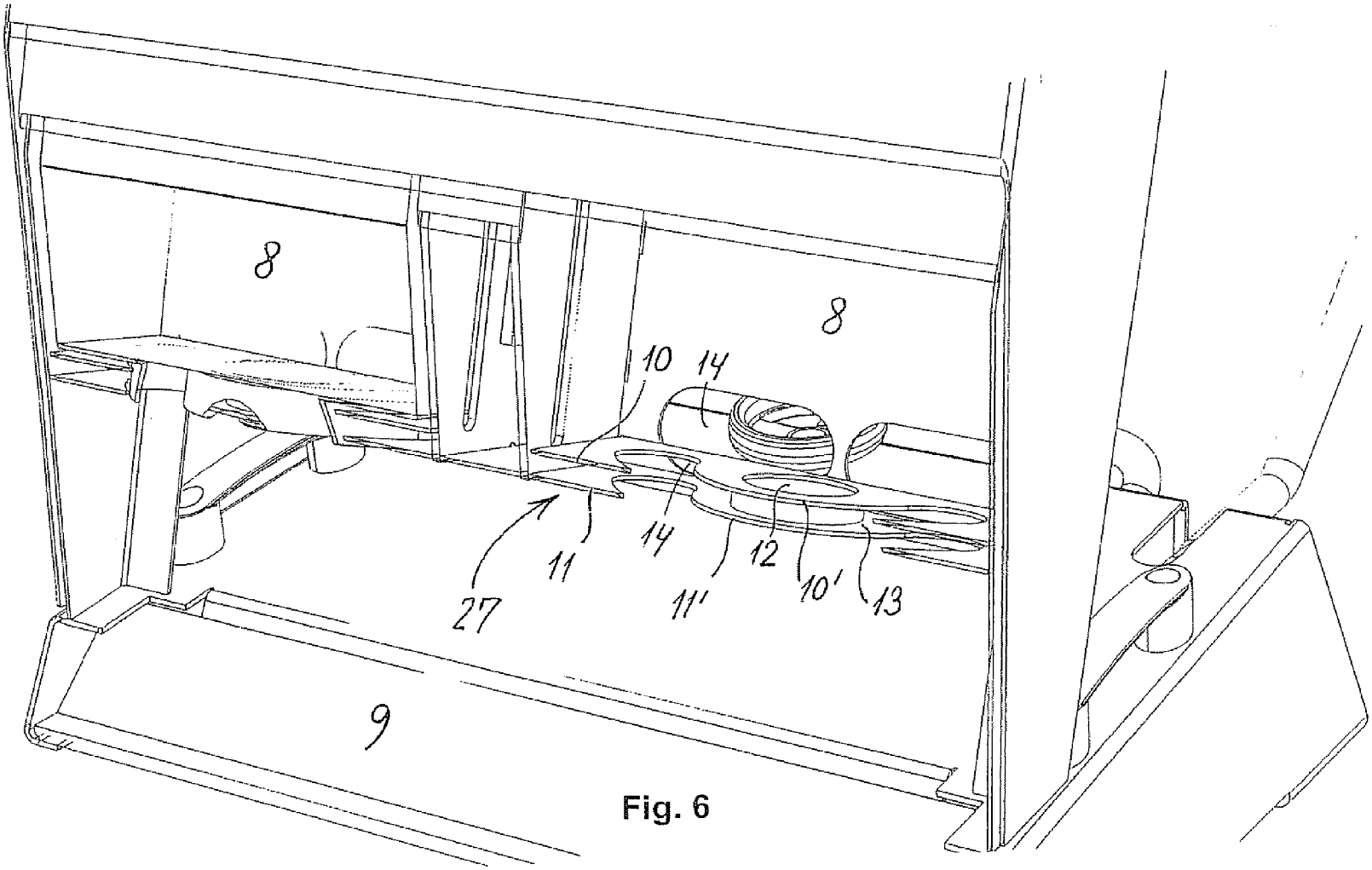
FIG. 6 shows in detail the dual-chamber interface that between the receptacle chamber 8 and the exhaust chamber 9 comprises an intermediate chamber 13 bounded by wall portions 10 and 11. through which wall portions openings 10' and 11' provide for communication from the receptacle chamber 8 to the exhaust chamber through the outlet member 4 on the bag of adhesive material. The wall portions 10 and 11 are also provided with an opening 12 for accommodation of the inlet 3 of the bag. Both the lower portion of the receptacle chamber and the intermediate chamber are provided with openings 14 leading to the rear portion of the apparatus.

With reference to FIG. 6 there is shown in detail a cross sectional view of a dual-chamber interface structure generally designated by reference numeral 27, which between the receptacle chamber 8 and the exhaust chamber 9 comprises an intermediate chamber 13 bounded by wall portions 10 and 11, through which wall portions openings 10' and 11' provide for communication from the receptacle chamber 8 to the exhaust chamber 9 through the outlet member 4 on the bag of adhesive material, which outlet member 4 can pass from the receptacle chamber 8 via the first wall 10, via the intermediate chamber 13 and to the exhaust chamber 9 via the second wall 11. The wall portions 10 and 11 are also provided with an opening 12 for accommodation of the inlet 3 of the bag. Both the lower portion of the receptacle chamber 8 and the intermediate chamber 13 are provided with openings 14 leading to a rear portion of the apparatus.

According to an alternative embodiment said interface may comprise only one wall portion (10) provided with the aperture 10' for co-operation with the outlet member of the container containing adhesive material.

According to a preferred embodiment to be described in connection with FIG. 20 below the through openings 10' and 11' are displaced relative to each other, corresponding to an outlet 4 from the container that is inclined relative to the end plate 2 of the container. In this embodiment the outlet 4 can only pass from the receptacle chamber 8 to the exhaust chamber 9 if both the shape, the dimensions and the inclination of the outlet is correct, i.e. corresponds to the specific interface structure of the apparatus. By these means there is provided a very powerful means of avoiding the use of unauthorized containers in the apparatus according to the invention.

Figure 7:
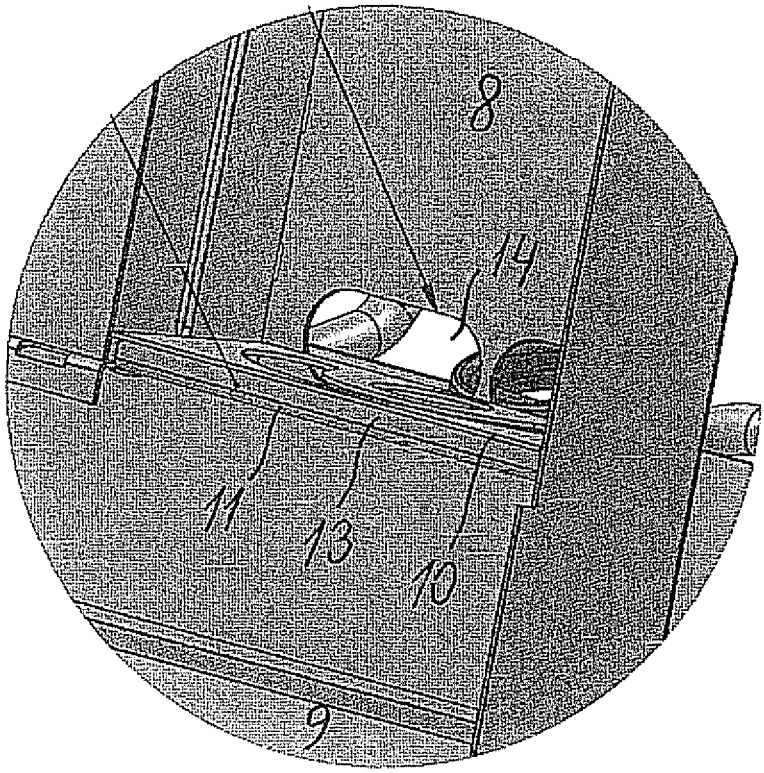
FIG. 7 shows essentially the same detail as FIG. 6, i.e. the dual-chamber system that prevents application of an unoriginal or unauthorised bag in the apparatus. Thus, the adhesive material will run backwards through the openings 14 if a bag without the appropriate end plate or gable 2 is used.

With reference to FIG. 7 there is shown the dual-chamber system that was also shown in FIG. 6 that prevents application of an unoriginal or unauthorised bag in the apparatus. Thus, the adhesive material will run backwards to a rear portion 28 (see FIG. 19) through the openings 14 if a bag without the appropriate end plate or gable 2 is used.

Figure 8:
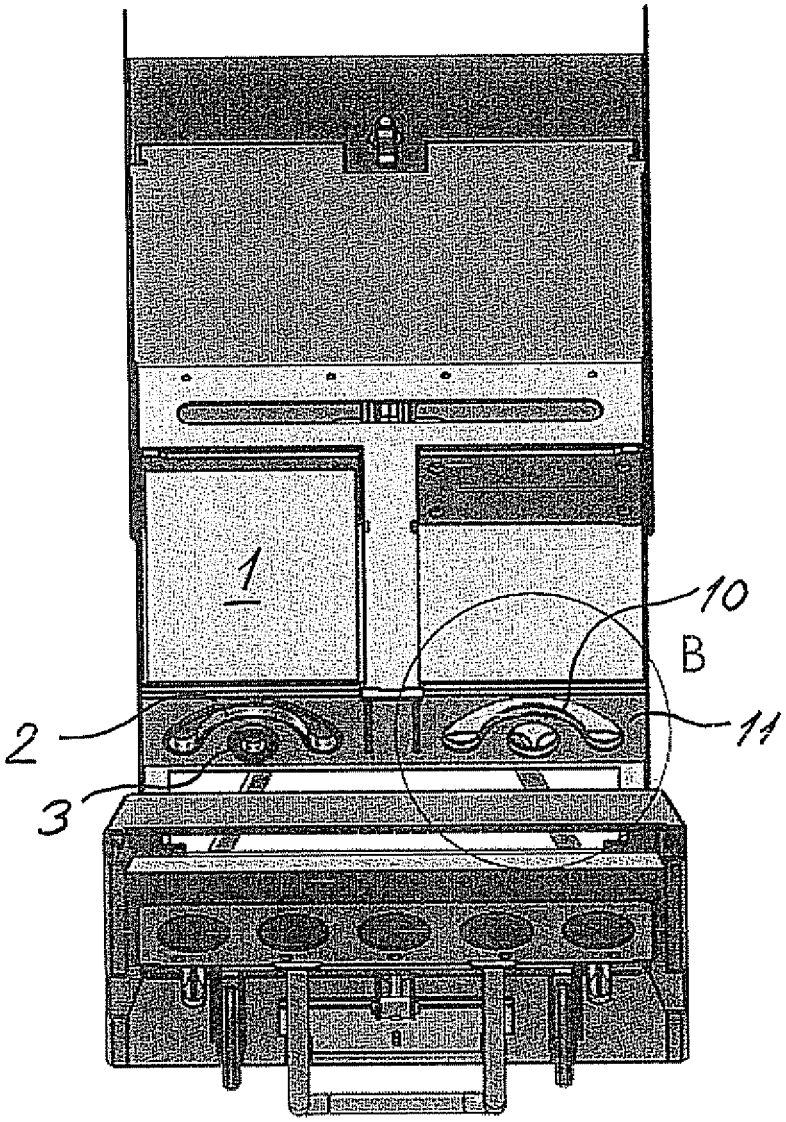
FIGS. 8, 9 and 10 show various pictures of the apparatus.
Figure 9:
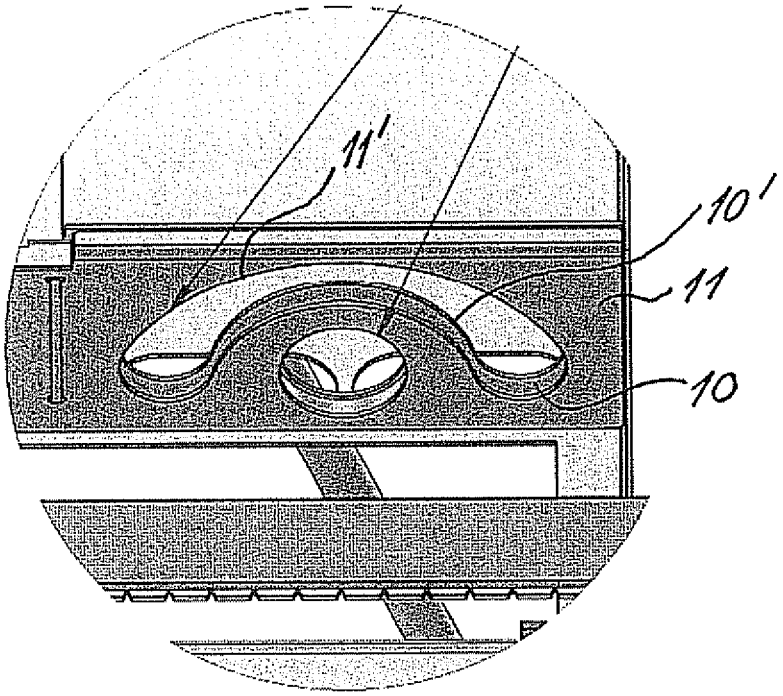
Figure 10:
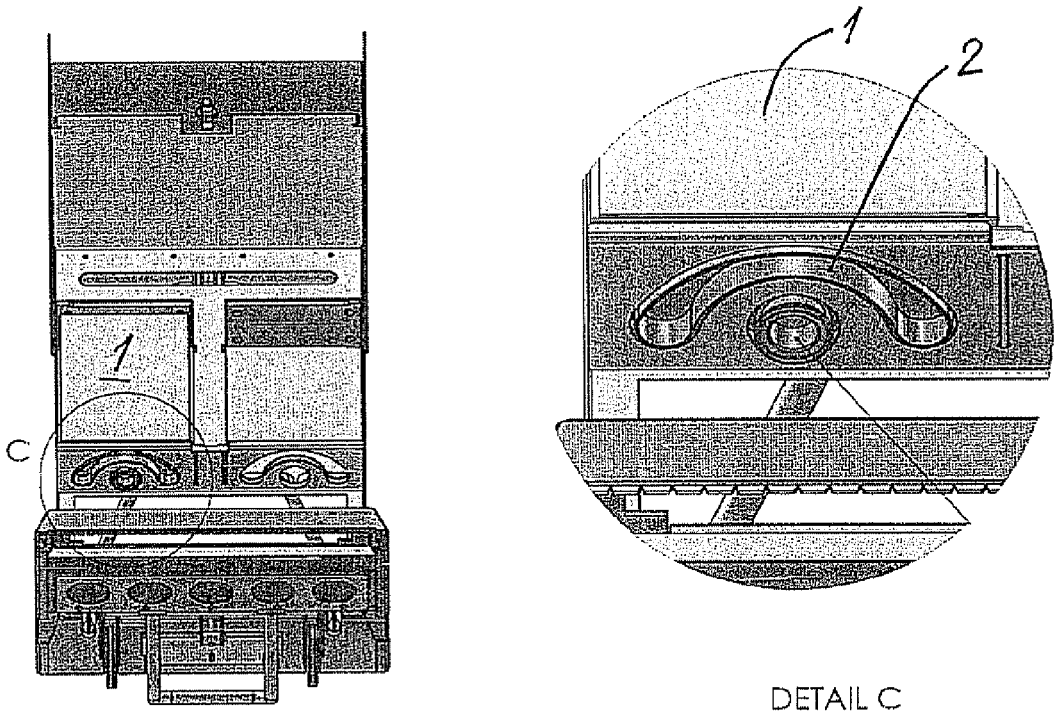

With reference to FIGS. 8, 9 and 10 there are shown various pictures of the apparatus. In these figures only the left receptacle chamber is provided with a container.

Figure 11:
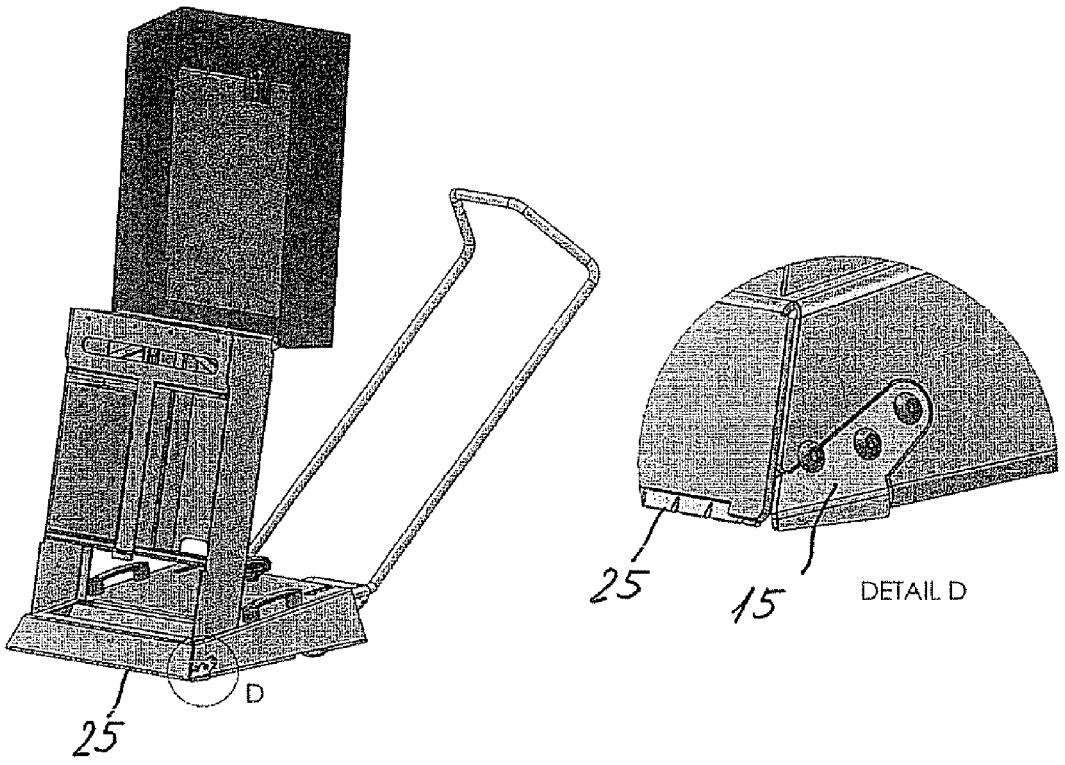
FIG. 11 shows a further advantageous detail of the apparatus according to the invention. namely the provision of exchangeable side pieces 15 provided at those portions of the apparatus that are prone to wear during use of the apparatus.

With reference to FIG. 11 there is shown a further advantageous detail of the apparatus according to the invention, namely the provision of exchangeable side pieces 15 provided at those portions of the apparatus that are prone to wear during use of the apparatus.

Figure 12:
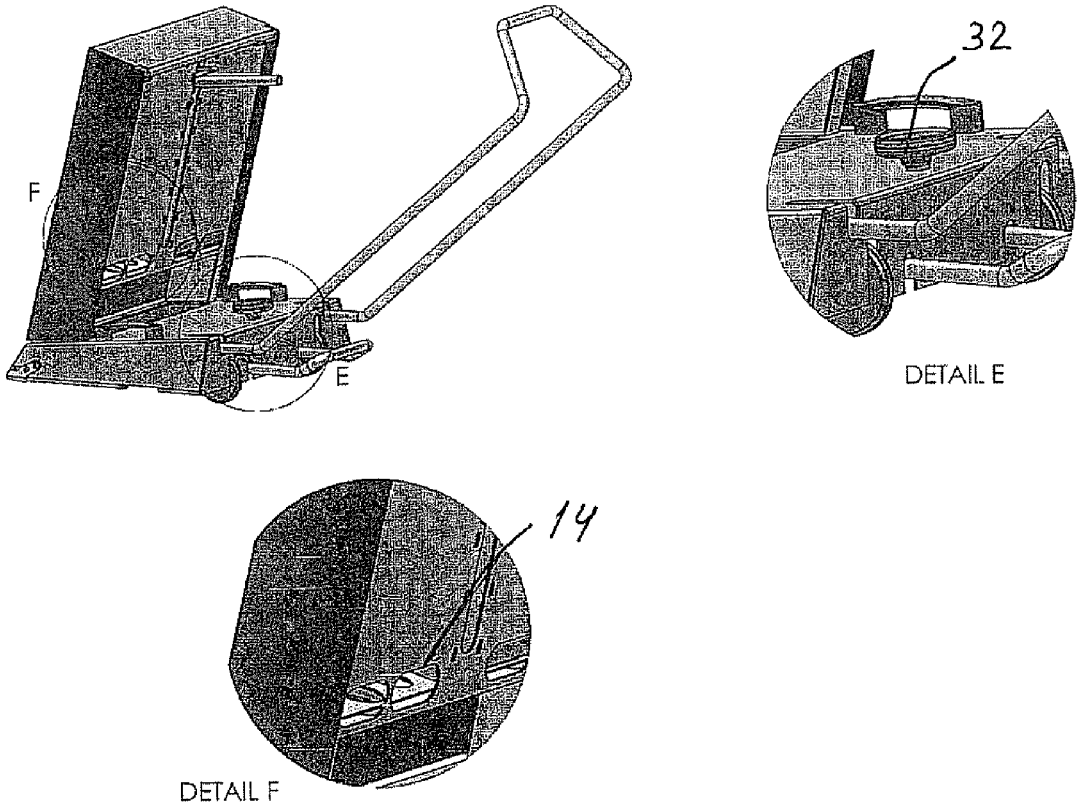
FIG. 12 shows further details of the apparatus.

With reference to FIG. 12 there is shown further details of the apparatus, specifically a control wheel 32 for controlling the thickness of the layer of adhesive laid out on a floor.

Figure 13:
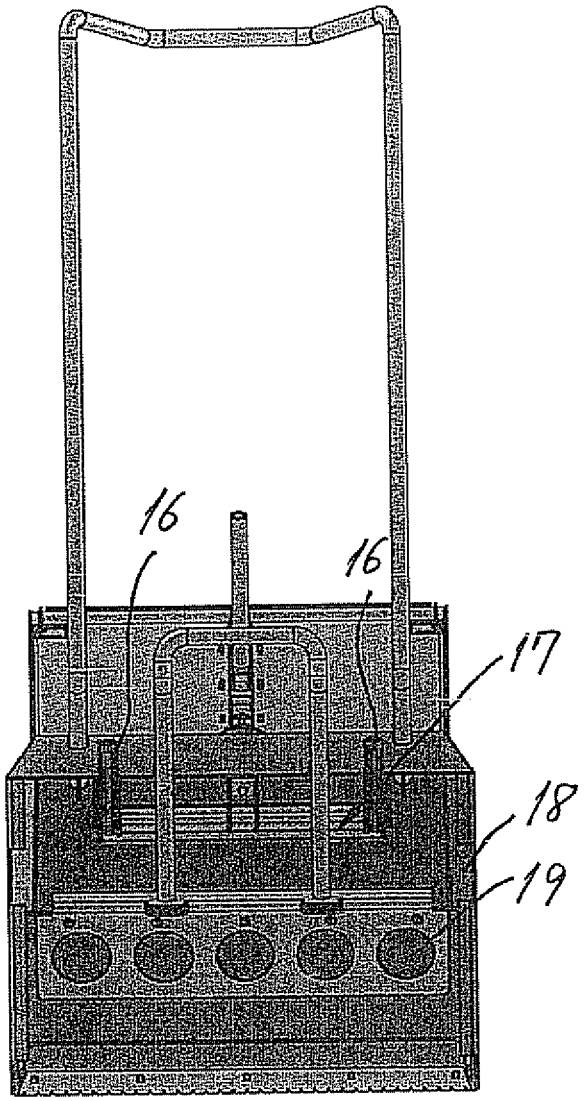
FIG. 13 shows the apparatus seen from the bottom comprising a hinge system 17 for the wheels 16, a slide gate 19 and an opening 18 for dismounting the slide gate 19.

With reference to FIG. 13 there is shown the apparatus seen from the bottom comprising a hinge system 17 for the wheels 16, a slide gate 19 and an opening 18 for dismounting the slide gate 19.

Figure 14:
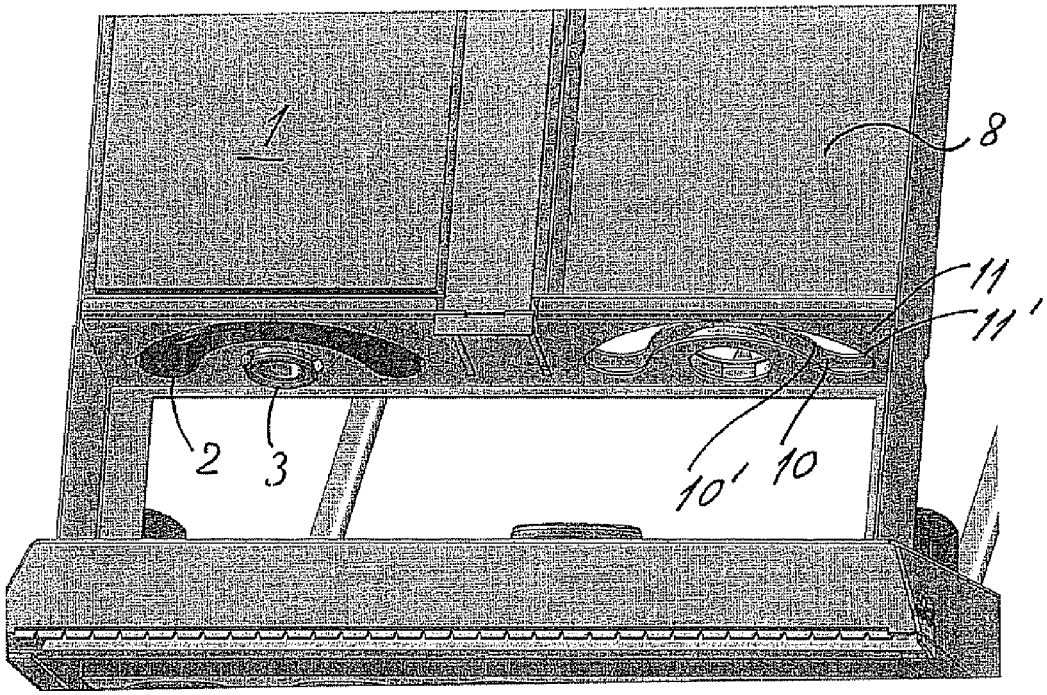
FIGS. 14 and 15 show further details of the apparatus.
Figure 15:
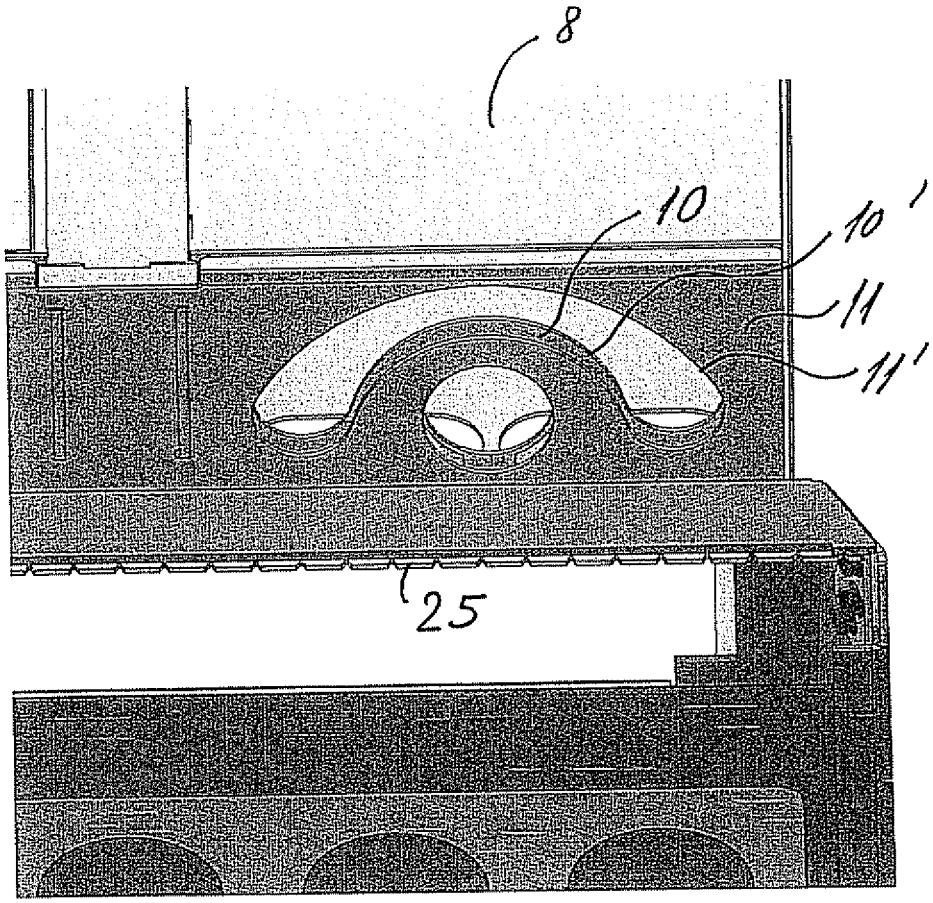

With reference to FIGS. 14 and 15 there are shown further details of the apparatus. The dual-wall structure of the interface separating the receptacle chambers 8 and the exhaust chamber 9 is clearly shown.

With reference to FIG. 16 there is shown an alternative design 20 of an outlet member of the bag 1.

With reference to FIG. 17 there is shown another alternative design 21 of an outlet member of the bag 1 and an end plate or gable 22 glued to the corresponding end face of the bag and an inlet member 23 welded on the bag 1.

Figure 18:
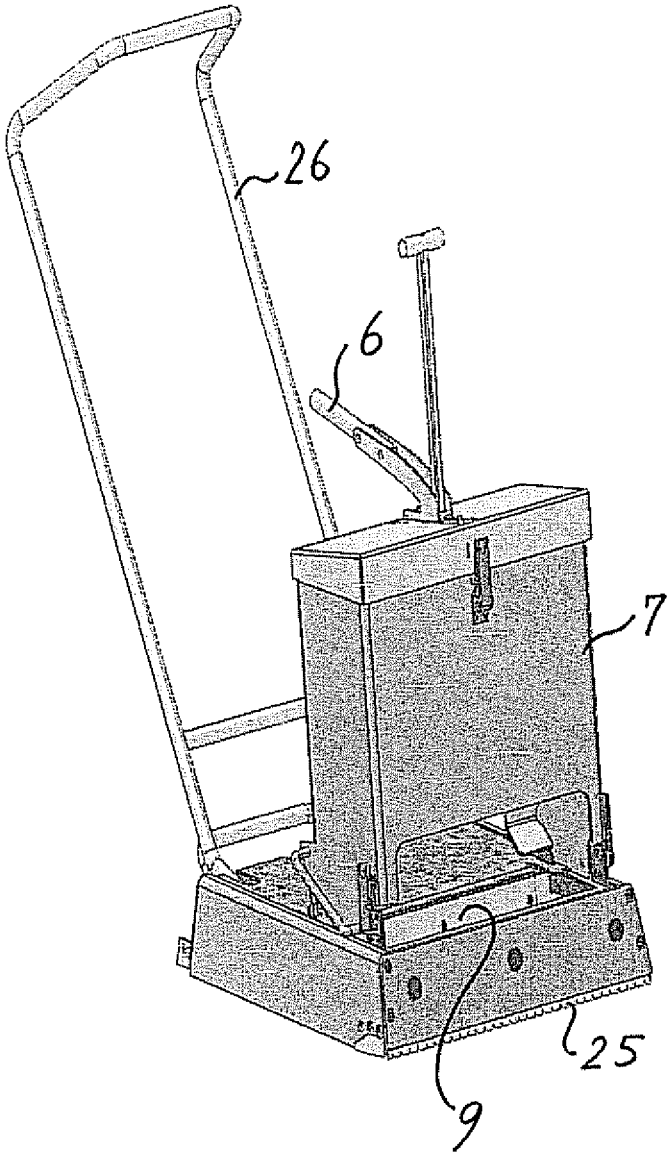
FIGS. 18 and 19 show a second embodiment of the apparatus according to the invention.
Figure 19:
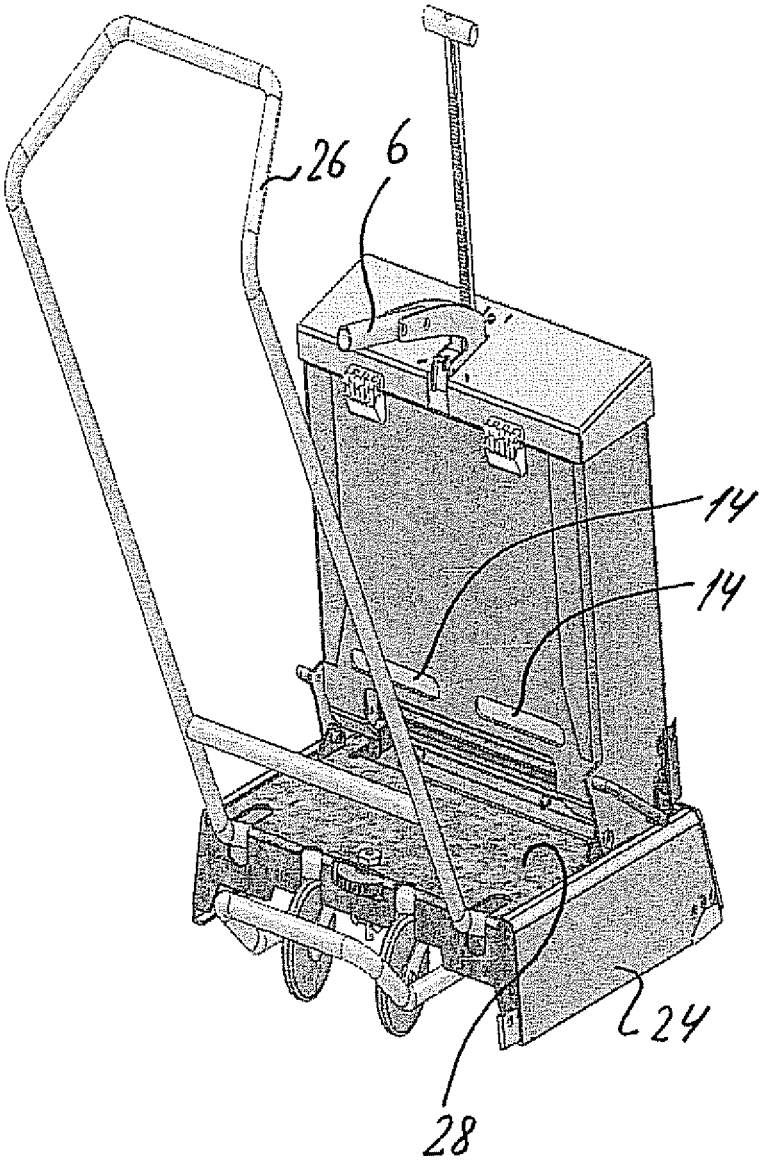

With reference to FIGS. 18 and 19 there is shown a second embodiment of the apparatus according to the invention.

Figure 20:
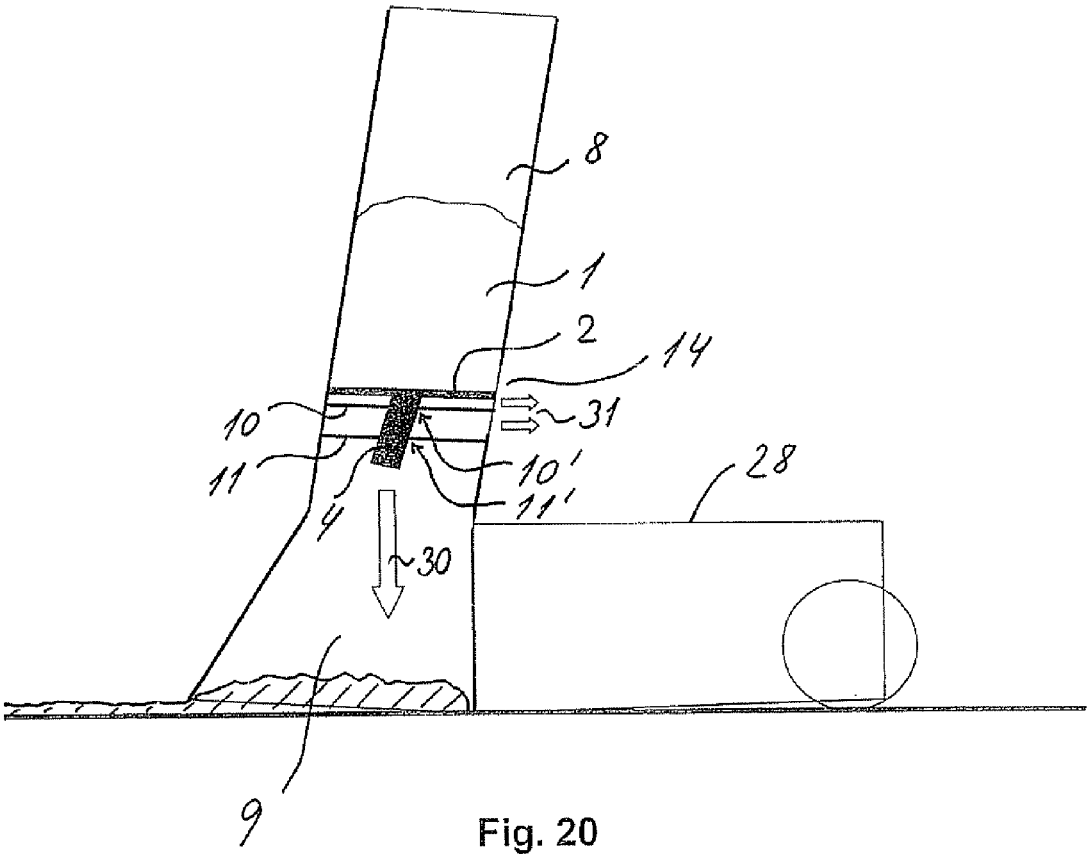
FIG. 20 is a schematic view of an apparatus according to the invention used to illustrate an important detail of a preferred embodiment.

With reference to FIG. 20 there is shown a schematic side view of an embodiment of the apparatus according to the present invention illustrating a preferred implementation of the interface structure separating the receptacle chambers 8 from the exhaust chamber 9. The apparatus comprises a receptacle chamber 8, in which there is placed a container for adhesive material. The container comprises a flexible bag portion and an end plate 2 in which there is provided an outlet 4, inclined relative to the plane of the end plate 2. The exhaust member 4 is passed through a first through opening 10' provided in a first wall 10 of an interface structure separating the receptacle chamber 8 from the exhaust chamber 9 of the apparatus. The exhaust member 4 is further passed through a second through opening 11' provided in a second wall 11 of the interface structure. The first and second through openings 10' and 11' are displaced relative to each other, such that only an outlet 4 of the correct inclination relative to the end plate 2 can pass through both openings 10' and 11' and into the exhaust chamber 9 of the apparatus. When the container and outlet 4 is correctly positioned as shown, adhesive will be forced from the container into the exhaust chamber 9 by application of the pump handle 6 (c.f. FIGS. 18 and 19) as indicated by 30 in FIG. 20. If a container that is not provided with the correct outlet fitting into the through openings 10' and 11' and with the correct inclination, at least a portion of adhesive will upon application of the handle 6 leave the container via the opening 14 in the rear wall of the receptacle chamber 8 as indicated by 31 in FIG. 20. Hence only a minor portion of the adhesive leaving the container will pass to the exhaust chamber 9 and the apparatus will be prevented from functioning satisfactorily. The adhesive leaving through the opening 14 will collect on the rear portion 28 of the apparatus.

The two walls 10 and 11 of the interface structure form an intermediate chamber 13 between the walls, and adhesive that due to the application of an incorrect container will be provided to this intermediate chamber 13 will also leave this chamber via the opening 14 in the rear wall of the receptacle chamber.

An alternative to the dual-wall interface structure described in FIG. 20 is an interface structure only comprising a single wall, for instance 10, but with a sufficient wall thickness that an inclined channel can be formed through the thick wall, which channel, in analogy to the embodiment shown in FIG. 20, will require a given inclination of the outlet 4 of the container, for the outlet 4 to pass through the interface wall and into the exhaust chamber 9 of the apparatus.

A further alternative would consist in applying more than two interface walls provided with through openings properly displaced relative to each other to let an inclined outlet of the container through to the exhaust chamber 9 of the apparatus.

Figure 21:
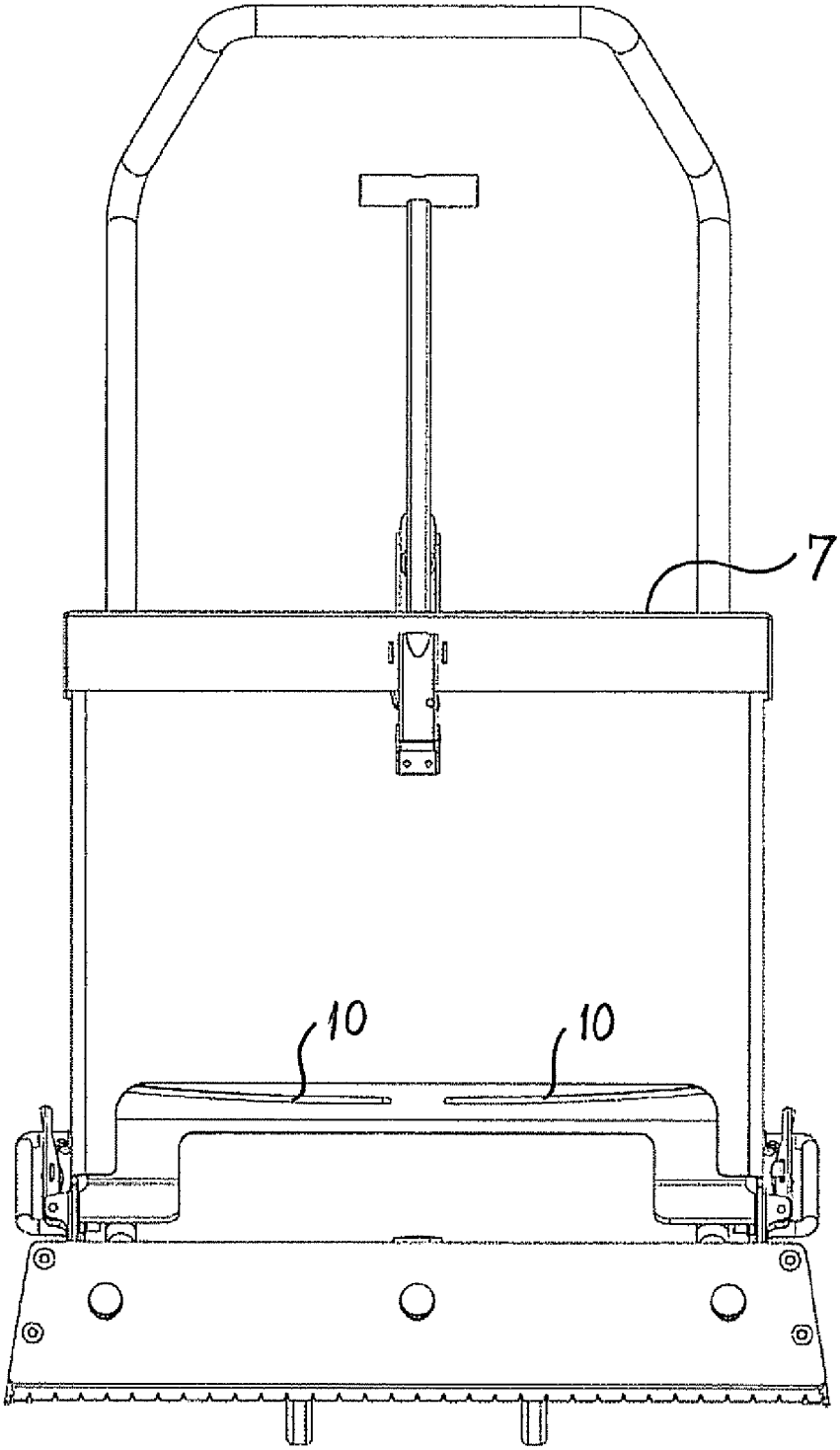
FIGS. 21, 22 and 23 are further schematic representations of the second embodiment of the invention showing among others that only a single receptacle chamber is used in this embodiment and that the container for adhesive material in this case has two outlets of a generally curved shape.
Figure 22:
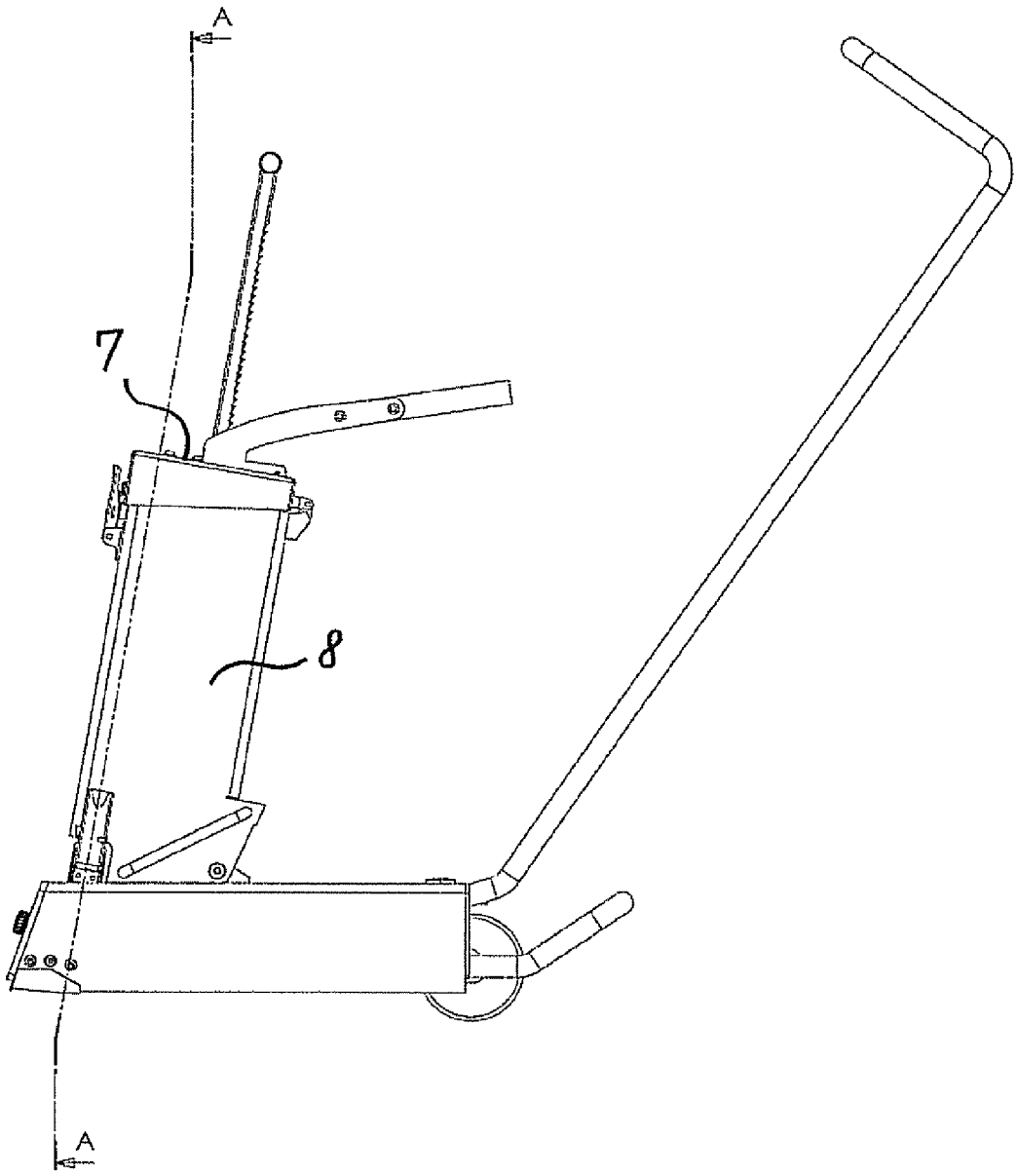
Figure 23:
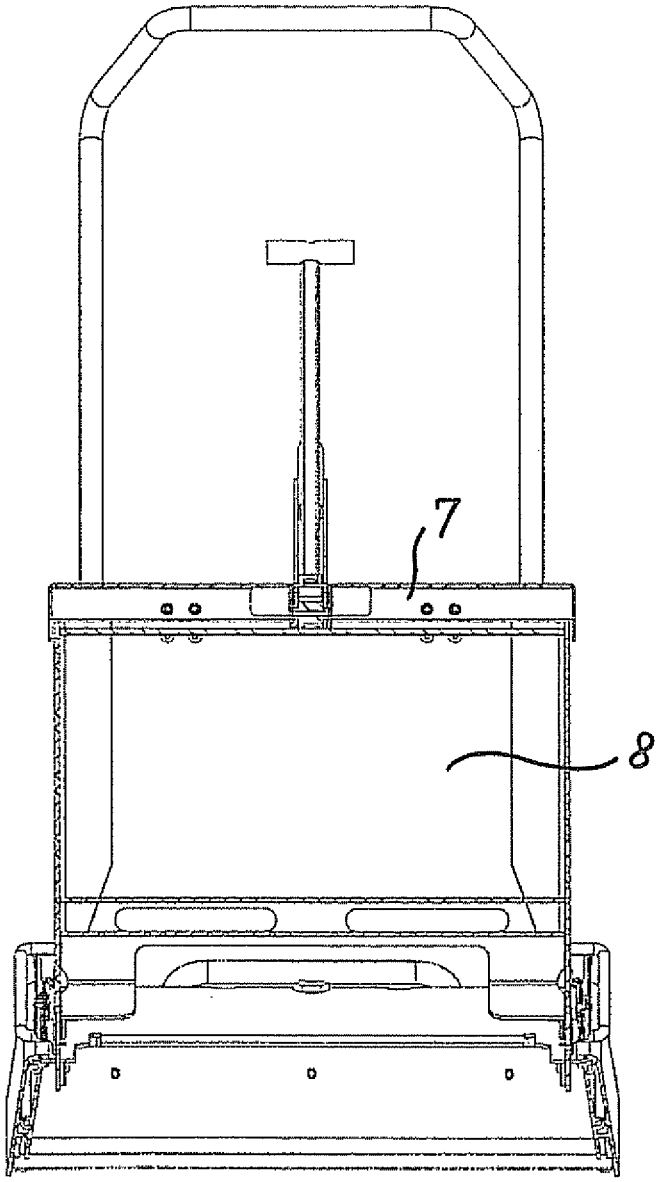

With reference to FIGS. 21, 22 and 23 there are shown further schematic representations of the second embodiment of the invention. FIG. 23 indicates that in this embodiment only a single receptacle chamber 8 and also from these figures the alternative placement of the lid portion 7 at the top of the receptacle chamber is apparent. From FIG. 21 it is apparent that the container used in connection with this embodiment of the apparatus of the invention has two outlets corresponding to the two through openings 10 in the interface structure of the apparatus shown in FIG. 21, which are in this embodiment of a generally curved shape.

The invention claimed is:

1. A combination of an apparatus for the application of adhesive materials for the laying of flooring or roofing surfaces and a container containing adhesive materials, the apparatus comprising:

a frame to which a trowel blade (25) is secured;

means for positioning said trowel blade (25) with regard to a subfloor or surface over which said trowel blade is to be moved;

at least one receptacle chamber (8) for said container, wherein a first wall portion (10) of said receptacle chamber (8) is provided with a first opening (10') through the first wall portion (10) of such a shape that the first opening (10') mates with a corresponding outlet (4) provided on said container (1), the receptacle chamber (8) comprising a second wall portion (11) juxtaposed to said first wall portion (10), whereby an intermediate chamber (13) is defined by said first and second wall portions (10, 11), and where the second wall portion (11) is provided with a second opening (11") of such a shape. and placed relative to said first opening (10'), such that said outlet (4) of the container can pass through said first opening (10') via said intermediate chamber (13) and through said second opening (11"), thereby providing fluid communication between the container and an exhaust chamber (9);

the container comprising a flexible bag portion (1) attached to an end plate (2), said outlet (4) being provided in said end plate (2), wherein said outlet (4) is inclined relative to said end plate (2), the dimensions, shapes and inclination of the outlet (4) being such that it snugly fits between the first and second wall portions (10, 11) between the receptacle chamber (8) and the exhaust chamber (9) of said apparatus.

2. The combination according to claim 1, wherein said second through opening (11") is displaced relative to said first opening (10').

3. The combination according to claim 1, wherein said intermediate chamber (13) is in fluid communication with at least one third opening (14) leading from the intermediate chamber (13) to a rear portion (28) of the apparatus.

4. The combination according to claim 1, wherein said first wall portion (10) comprises a channel of a length corresponding to the length of the outlet (4) in the container (1). the channel being inclined relative to the first wall portion (10) corresponding to the inclination of the outlet (4) in the container.

5. The combination according to claim 1, wherein the container further comprises an inlet (3) for the supply of adhesive material to the container, said inlet (3) being provided in said end plate (2).

6. The combination according to claim 1, wherein said outlet (4) is provided with a film (5) blocking the passage of adhesive material from the bag portion (1) through the outlet (4) prior to the use of the container and which film (5) must be at least partly broken or cut away, when the container is placed in the receptacle chamber (8) of the apparatus.

7. The combination according to claim 1, wherein said outlet (4) has a predetermined depth substantially in a flow direction of the adhesive material through the outlet.

8. The combination according to claim 5, wherein said outlet (4) is provided with a film (5) blocking the passage of adhesive material from the bag portion (1) through the outlet (4) prior to the use of the container and which film (5) must be at least partly broken or cut away, when the container is placed in the receptacle chamber (8) of the apparatus.

9. The combination according to claim 5, wherein said outlet (4) has a predetermined depth substantially in a flow direction of the adhesive material through the outlet.

10. The combination according to claim 6, wherein said outlet (4) has a predetermined depth substantially in a flow direction of the adhesive material through the outlet.

* * * * *

UNITED STATES PATENT AND TRADEMARK OFFICE

CERTIFICATE OF CORRECTION

PATENT NO. : 9,067,232 B2
APPLICATION NO. : 13/807985
DATED : June 30, 2015
INVENTOR(S) : Nicolai Gaardsoe et al.

It is certified that error appears in the above-identified patent and that said Letters Patent is hereby corrected as shown below:

Title page, item (74), in column 2, in "Attorney, Agent, or Firm", line 1, delete "O'Neil" and insert -- O'Neill --, therefor.

Specification

In column 1, line 9, delete "Jul. 4, 2011." and insert -- Jul. 4, 2011, --, therefor.

In column 4, line 16, delete "11." and insert -- 11, --, therefor.

In column 4, line 31, delete "invention." and insert -- invention, --, therefor.

Claims

In column 8, line 21, in claim 1, delete "shape." and insert -- shape, --, therefor.

In column 8, line 45, in claim 4, delete "(1)." and insert -- (1), --, therefor.

Signed and Sealed this
Nineteenth Day of January, 2016

Michelle K. Lee

Michelle K. Lee
*Director of the United States Patent and Trademark Office*